US006834474B2

(12) United States Patent
Dutra et al.

(10) Patent No.: US 6,834,474 B2
(45) Date of Patent: Dec. 28, 2004

(54) PACKAGE WITH ZIPPER CLOSURE

(75) Inventors: Herberto Dutra, Elk Grove Village, IL (US); Mark Charles Mikol, Arlington Heights, IL (US)

(73) Assignee: Kraft Foods Holdings, Inc., Northfield, IL (US)

( * ) Notice: Subject to any disclaimer, the term of this patent is extended or adjusted under 35 U.S.C. 154(b) by 0 days.

(21) Appl. No.: 10/251,639

(22) Filed: Sep. 20, 2002

(65) Prior Publication Data

US 2003/0074860 A1 Apr. 24, 2003

Related U.S. Application Data

(62) Division of application No. 09/364,624, filed on Jul. 29, 1999, now Pat. No. 6,477,820.

(51) Int. Cl.[7] ..... B65B 61/20

(52) U.S. Cl. ..... 53/133.4; 53/133.1; 53/133.3; 493/212; 493/927

(58) Field of Search ..... 53/133.1, 133.2, 53/133.3, 133.4, 412, 450, 452, 476, 477, 478, 410, 139.2; 493/212, 213, 214, 927; 383/203, 210

(56) References Cited

U.S. PATENT DOCUMENTS

| | | | |
|---|---|---|---|
| 2,994,469 | A | 8/1961 | Troup et al. |
| 3,181,583 | A | 5/1965 | Lingenfelter |

(List continued on next page.)

FOREIGN PATENT DOCUMENTS

| | | |
|---|---|---|
| EP | 0 443 867 A1 | 8/1991 |
| EP | 1 164 087 A2 | 12/2001 |
| JP | 55-89068 | 7/1980 |
| JP | 61-259959 | 11/1986 |
| JP | 01-226556 | 9/1989 |
| JP | 04-173510 | 6/1992 |
| JP | 4-215954 | 8/1992 |

(List continued on next page.)

OTHER PUBLICATIONS

Exhibit A shows drawings of a package used by the Assignee of the present invention, which is admittedly prior art with respect to the above captioned patent application. Exhibit A includes three figures describing a package which is prior art wit respect to the above–captioned patent application.

"Hefty's Plastic Zipper Bag is Rapping Rivals", by Dean Starkman, article in *The Wall Street Journal*, date unknown.

*Primary Examiner*—Louis Huynh
(74) *Attorney, Agent, or Firm*—Fitch, Even, Tabin & Flannery

(57) ABSTRACT

A method and apparatus for providing a slider-equipped zipper on a pouch in a form/fill/seal operation. In the preferred embodiment of the invention, a foldable slider is employed, and is shifted from an open configuration to a closed configuration for installation on zipper strips on the pouch. Stops are preferably provided at the ends of the zipper strips by application of heat and pressure to form a boss on one side and a corresponding recess on the other, without requiring additional material. A hermetic peelable seal preferably is provided beneath the zipper strips. The slider preferably is applied to the zipper strips immediately before or immediately after filling, or immediately after formation of the peelable seal. Means may be provided to shift the position of the slider to close the zipper. The slider may include means to secure it in place by a mechanical locking mechanism such as a snap fit engagement, or the slider may be welded in closed position by application of heat, or by ultrasonic welding. A vacuum engagement mechanism may be employed to separate the walls of the pouch to a predetermined position relative to one another while positioning and closing the slider.

1 Claim, 3 Drawing Sheets

U.S. PATENT DOCUMENTS

| | | | | | |
|---|---|---|---|---|---|
| 3,234,614 | A | | 2/1966 | Plummer | |
| 3,534,520 | A | | 10/1970 | Moran | |
| 3,579,747 | A | | 5/1971 | Hawley | |
| 3,660,875 | A | | 5/1972 | Gutman | |
| 3,790,992 | A | | 2/1974 | Herz | |
| 3,806,998 | A | | 4/1974 | Laguerre | |
| 3,819,106 | A | | 6/1974 | Schuster | |
| 4,186,786 | A | | 2/1980 | Kirkpatrick | |
| 4,262,395 | A | | 4/1981 | Kosky | |
| 4,355,494 | A | | 10/1982 | Tilman | |
| 4,516,268 | A | | 5/1985 | Kamp | |
| 4,534,158 | A | | 8/1985 | McClosky | |
| 4,586,319 | A | | 5/1986 | Ausnit | |
| 4,601,694 | A | | 7/1986 | Ausnit | |
| 4,617,785 | A | | 10/1986 | Chikatani et al. | |
| 4,646,511 | A | | 3/1987 | Boeckmann et al. | |
| 4,709,533 | A | | 12/1987 | Ausnit | |
| 4,727,709 | A | | 3/1988 | Zieke et al. | |
| 4,744,674 | A | * | 5/1988 | Nocek | 53/410 |
| 4,745,731 | A | | 5/1988 | Talbott et al. | |
| 4,786,190 | A | * | 11/1988 | Van Erden et al. | 383/210 |
| 4,812,074 | A | | 3/1989 | Ausnit et al. | |
| 4,848,064 | A | * | 7/1989 | Lems et al. | 53/133.3 |
| 4,878,987 | A | | 11/1989 | Ven Erden | |
| 4,894,975 | A | | 1/1990 | Ausnit | |
| 4,903,841 | A | | 2/1990 | Ohsima et al. | |
| 4,909,017 | A | | 3/1990 | McMahon et al. | |
| 4,923,309 | A | * | 5/1990 | VanErden | 53/410 |
| 4,925,316 | A | * | 5/1990 | Van Erden et al. | 383/210 |
| 4,927,271 | A | | 5/1990 | Branson | |
| 4,945,714 | A | | 8/1990 | Bodolay et al. | |
| 5,010,627 | A | | 4/1991 | Herrington et al. | |
| 5,014,498 | A | | 5/1991 | McMahon | |
| 5,014,499 | A | | 5/1991 | Boeckmann | |
| 5,020,194 | A | | 6/1991 | Herrington et al. | |
| 5,036,643 | A | | 8/1991 | Bodolay | |
| 5,067,208 | A | | 11/1991 | Herrington, Jr. et al. | |
| 5,080,747 | A | * | 1/1992 | Veix | 493/189 |
| 5,088,971 | A | | 2/1992 | Herrington | |
| 5,127,208 | A | | 7/1992 | Custer et al. | |
| 5,131,121 | A | * | 7/1992 | Herrington et al. | 24/436 |
| 5,140,796 | A | | 8/1992 | Pope | |
| 5,141,795 | A | | 8/1992 | Kai et al. | |
| 5,161,286 | A | | 11/1992 | Herrington, Jr. et al. | |
| 5,167,107 | A | | 12/1992 | Terminella et al. | |
| 5,179,816 | A | | 1/1993 | Wojnicki | |
| 5,186,543 | A | | 2/1993 | Cochran | |
| 5,189,764 | A | | 3/1993 | Herrington et al. | |
| 5,211,482 | A | * | 5/1993 | Tilman | 493/213 |
| 5,238,306 | A | | 8/1993 | Heintz et al. | |
| 5,247,781 | A | | 9/1993 | Runge | |
| 5,283,932 | A | | 2/1994 | Richardson et al. | |
| 5,301,395 | A | | 4/1994 | Richardson et al. | |
| 5,322,579 | A | | 6/1994 | Van Erden | |
| 5,400,565 | A | | 3/1995 | Terminella et al. | |
| RE34,905 | E | | 4/1995 | Ausnit | |
| 5,405,478 | A | | 4/1995 | Richardson et al. | |
| 5,417,035 | A | | 5/1995 | English | |
| 5,435,864 | A | | 7/1995 | Machacek et al. | |
| 5,442,837 | A | * | 8/1995 | Morgan | 24/430 |
| 5,448,807 | A | | 9/1995 | Herrington, Jr. | |
| 5,482,375 | A | | 1/1996 | Richardson et al. | |
| 5,492,411 | A | | 2/1996 | May | |
| 5,505,037 | A | | 4/1996 | Terminella et al. | |
| 5,519,982 | A | * | 5/1996 | Herber et al. | 53/412 |
| 5,525,363 | A | | 6/1996 | Herber et al. | |
| 5,561,966 | A | | 10/1996 | English | |
| 5,564,259 | A | | 10/1996 | Stolmeier | |
| 5,664,299 | A | | 9/1997 | Porchia et al. | |
| 5,664,406 | A | | 9/1997 | Smith | |
| 5,669,715 | A | | 9/1997 | Dobreski et al. | |
| 5,681,115 | A | | 10/1997 | Diederich et al. | |
| 5,682,730 | A | | 11/1997 | Dobreski | |
| 5,687,549 | A | | 11/1997 | Jostler et al. | |
| 5,713,669 | A | | 2/1998 | Thomas et al. | |
| 5,722,128 | A | | 3/1998 | Toney et al. | |
| 5,725,312 | A | | 3/1998 | May | |
| 5,733,045 | A | | 3/1998 | Jostler et al. | |
| 5,743,070 | A | | 4/1998 | Lerner et al. | |
| 5,746,043 | A | | 5/1998 | Terminella et al. | |
| 5,768,852 | A | | 6/1998 | Terminella et al. | |
| 5,769,772 | A | | 6/1998 | Wiley | |
| 5,775,812 | A | | 7/1998 | St. Phillips et al. | |
| 5,776,045 | A | | 7/1998 | Bodolay et al. | |
| 5,782,733 | A | | 7/1998 | Yeager | |
| 5,788,378 | A | | 8/1998 | Thomas | |
| 5,823,933 | A | | 10/1998 | Yeager | |
| 5,826,401 | A | | 10/1998 | Bois | |
| 5,833,791 | A | | 11/1998 | Bryniarski et al. | |
| 5,836,056 | A | | 11/1998 | Porchia et al. | |
| 5,845,465 | A | | 12/1998 | Bennett | |
| 5,845,466 | A | | 12/1998 | Bennett | |
| 5,867,875 | A | | 2/1999 | Beck et al. | |
| 5,871,281 | A | | 2/1999 | Stolmeier et al. | |
| 5,878,549 | A | | 3/1999 | Littmann et al. | |
| 5,884,452 | A | | 3/1999 | Bois | |
| 5,896,627 | A | | 4/1999 | Cappel et al. | |
| 5,902,047 | A | | 5/1999 | Yeager | |
| 5,904,425 | A | | 5/1999 | May | |
| 5,906,438 | A | | 5/1999 | Laudenberg | |
| 5,919,535 | A | | 7/1999 | Dobreski et al. | |
| 5,924,173 | A | | 7/1999 | Dobreski et al. | |
| 5,930,983 | A | | 8/1999 | Terminella et al. | |
| 5,937,615 | A | | 8/1999 | Forman | |
| 5,938,337 | A | | 8/1999 | Provan et al. | |
| 5,944,425 | A | | 8/1999 | Forman | |
| 5,947,603 | A | | 9/1999 | Tilman | |
| 5,950,285 | A | | 9/1999 | Porchia et al. | |
| 5,956,815 | A | | 9/1999 | O'Connor et al. | |
| 5,956,924 | A | | 9/1999 | Thieman | |
| 5,964,532 | A | | 10/1999 | St. Phillips et al. | |
| 5,983,594 | A | | 11/1999 | Forman | |
| 5,985,384 | A | | 11/1999 | Shibata | |
| 5,996,187 | A | | 12/1999 | Tanaka et al. | |
| 6,000,197 | A | | 12/1999 | Ausnit | |
| 6,019,512 | A | | 2/2000 | Yeager | |
| 6,029,428 | A | | 2/2000 | Terminella et al. | |
| 6,036,364 | A | | 3/2000 | Heuvel | |
| 6,044,621 | A | | 4/2000 | Malin et al. | |
| 6,047,450 | A | | 4/2000 | Machacek et al. | |
| 6,047,521 | A | | 4/2000 | Terminella et al. | |
| 6,071,011 | A | | 6/2000 | Thomas et al. | |
| 6,088,887 | A | | 7/2000 | Bois | |
| 6,131,369 | A | | 10/2000 | Ausnit | |
| 6,131,370 | A | | 10/2000 | Ausnit | |
| 6,138,436 | A | | 10/2000 | Malin et al. | |
| 6,138,439 | A | * | 10/2000 | McMahon et al. | 53/412 |
| 6,139,662 | A | | 10/2000 | Forman | |
| 6,148,588 | A | | 11/2000 | Thomas et al. | |
| 6,149,302 | A | | 11/2000 | Taheri | |
| 6,161,271 | A | | 12/2000 | Schreiter | |
| 6,177,172 | B1 | | 1/2001 | Yeager | |
| 6,178,722 | B1 | | 1/2001 | McMahon | |
| 6,183,134 | B1 | | 2/2001 | Malin | |
| 6,185,907 | B1 | | 2/2001 | Malin et al. | |
| 6,186,663 | B1 | | 2/2001 | Ausnit | |
| 6,195,967 | B1 | * | 3/2001 | Todd et al. | 53/139.2 |
| 6,199,351 | B1 | | 3/2001 | Mount | |
| 6,209,287 | B1 | | 4/2001 | Thieman | |
| 6,212,857 | B1 | | 4/2001 | Van Erden | |
| 6,216,423 | B1 | | 4/2001 | Thieman | |

6,219,993 B1 4/2001 Linkiewicz
6,220,754 B1 4/2001 Stiglic et al.
6,224,262 B1 5/2001 Hogan et al.
6,244,021 B1 * 6/2001 Ausnit et al. ..... 53/412
6,244,746 B1 6/2001 Tokita et al.
6,257,763 B1 7/2001 Stolmeier et al.
6,270,256 B1 8/2001 Todman
6,273,607 B1 8/2001 Buchman
6,286,189 B1 9/2001 Provan et al.
6,287,000 B1 9/2001 Buchman
6,287,001 B1 9/2001 Buchman
6,290,390 B1 9/2001 Buchman
6,290,391 B1 9/2001 Buchman
6,290,393 B1 9/2001 Tomic
6,292,986 B1 9/2001 Provan et al.
6,293,896 B1 9/2001 Buchman
6,327,754 B1 * 12/2001 Belmont et al. ..... 24/389
6,327,837 B1 * 12/2001 Van Erden ..... 53/412
6,347,885 B1 2/2002 Buchman
6,360,513 B1 3/2002 Strand et al.
6,363,692 B2 4/2002 Thieman
6,376,035 B1 4/2002 Dobreski et al.
6,378,177 B1 4/2002 Athans et al.
6,386,760 B1 5/2002 Tomic
6,389,780 B1 5/2002 Coomber et al.
6,412,254 B1 7/2002 Tilman et al.
6,427,421 B1 8/2002 Belmont et al.
6,438,926 B1 8/2002 Thieman
6,449,924 B2 9/2002 McMahon et al.
6,470,551 B1 10/2002 Provan et al.
6,474,045 B2 11/2002 McMahon et al.
6,477,820 B1 * 11/2002 Dutra et al. ..... 53/412
6,477,821 B1 11/2002 Bois
6,481,183 B1 11/2002 Schmidt
6,499,272 B2 12/2002 Thieman
2001/0001164 A1 5/2001 Van Erden
2001/0010253 A1 8/2001 Forman
2001/0017950 A1 8/2001 Strand et al.
2001/0039235 A1 11/2001 Buchman
2001/0039783 A1 11/2001 McMahon et al.
2001/0042357 A1 11/2001 McMahon et al.
2001/0045083 A1 11/2001 McMahon et al.
2001/0053253 A1 12/2001 Buchman
2002/0017078 A1 2/2002 Thieman
2002/0064320 A1 5/2002 May
2002/0064321 A1 5/2002 May
2002/0064322 A1 5/2002 May
2002/0068668 A1 6/2002 Chow et al.
2002/0076122 A1 6/2002 Buchman
2002/0090489 A1 7/2002 Dobreski et al.
2002/0118896 A1 8/2002 Forman
2002/0134046 A1 9/2002 Bois
2002/0134050 A1 9/2002 Thieman
2002/0150313 A1 10/2002 Bois
2002/0152719 A1 10/2002 Kinigakis et al.
2002/0152720 A1 10/2002 Kinigakis et al.
2002/0173414 A1 11/2002 Leighton
2002/0178556 A1 12/2002 McMahon et al.
2002/0184858 A1 12/2002 Ausnit et al.
2002/0194818 A1 12/2002 Thieman

FOREIGN PATENT DOCUMENTS

JP 5-91909 4/1993
JP 5-91910 4/1993
JP 7-187202 7/1995
JP 9-216642 8/1997
JP 10-706 1/1998
JP 10-501714 2/1998
JP 10-503672 4/1998
JP 10-147352 6/1998
JP 10203539 A 8/1998
JP 11-20051 1/1999
JP 11157553 A 6/1999
JP 11-314648 11/1999
WO WO 98/24704 6/1998
WO WO 98/45180 10/1998
WO WO 01/96195 A1 12/2001

* cited by examiner 10
12
14
16
18
20
22
24
26
28
30
32
34
36
38
40
42
43
44
46
48
50
52
54
56
66
80
82
84

PACKAGE WITH ZIPPER CLOSURE

CROSS-REFERENCE TO RELATED APPLICATION

This is a divisional of U.S. patent application Ser. No. 09/364,624, filed Jul. 29, 1999 now U.S. Pat. No. 6,477,820.

FIELD OF THE INVENTION

The invention relates generally to packaging for food products, and more particularly to zipper-equipped reclosable pouches and methods and apparatus for forming, filling and sealing such pouches.

BACKGROUND OF THE INVENTION

In providing a commercially viable zipper-equipped package, among the considerations that must be addressed are ease of use and economy of manufacture. It is desirable that the package be capable of being formed, filled and sealed at high throughput rates. Additionally, the package must be durable to withstand the stresses of the form/fill/seal operation and subsequent shipping and handling without damage and without deterioration of appearance.

When handling products comprised of numerous small pieces such as shredded cheese, cereal, etc., the package maybe partly formed into an open-topped pouch, and product may be dispensed into the partially-formed pouch through the open top. One approach is to employ a vertical form/fill/seal system, an example of which is shown in U.S. Pat. No. 4,874,257, with the zipper being disposed vertically along one side of the package being formed, and the pouch being filled by gravity-induced flow of product downward from a filling spout. Another approach is illustrated by U.S. Pat. No. 5,519,982, in which the pouches travel horizontally as they are formed, filled and sealed.

In zipper-equipped package, where the ends of the zippers extend into seal areas, difficulty may be encountered in providing seals at high throughput rates, due to the increased thickness of the seal area at the ends of the zipper. Another problem is that opening and reclosing zippers may be difficult for the consumer, even where gripper beads are provided, as discussed in, e.g., U.S. Pat. No. 5,519,982.

To address the latter problem, a slider may be provided in conjunction with the zipper strips. Sliders that may be moved linearly to force the profiles together or apart are well known in the art. However, installation of the slider complicates the manufacturing process. Also, the slider may tend to split the joint between the package walls at the ends of the zipper track, requiring that stops be provided, which further complicates the manufacturing process. Various stop designs are shown in, e.g., U.S. Pat. Nos. 5,833,791; 5,405,478; 5,067,208; 5,448,807; and 5,442,837. U.S. Pat. No. 5,211,482 describes post-filling application of a zipper closure that includes a slider.

There is a continuing need for improved packages of the type described above, and for improved form/fill/seal operations for such packages which address the aforementioned considerations while avoiding the disadvantages of the prior art.

SUMMARY OF THE INVENTION

The invention provides a novel apparatus for providing a slider-equipped zipper fastener on a pouch in a form/fill/seal operation.

In the preferred embodiment of the invention, a foldable slider is employed, and is shifted from an open configuration to a closed configuration during installation on zipper strips on the pouch. Integral stops are preferably formed from the zipper material by application of heat and pressure to the ends of the zipper, without requiring installation of separate, discrete components.

A hermetic peelable seal preferably is provided beneath the zipper strips. The slider preferably is applied to the zipper strips immediately before or immediately after filling, or immediately after formation of the peelable seal.

The slider may include means to secure it in closed position on the zipper strips by a mechanical locking mechanism such as a snap fit engagement, or the slider may be welded in closed position by application of heat, or by ultrasonic welding.

An opening mechanism may be employed to separate the walls of the pouch to a predetermined position relative to one another while positioning and closing the slider. The opening mechanism may employ vacuum cups to engage the walls of the pouch.

The zipper strips are in an open position as the slider is installed. After installation of the slider on the zipper, the slider may be moved along the zipper to close the zipper.

The method and apparatus of the invention may be employed in conjunction with packaging of various food products, including but not limited to, e.g., cheese products in shredded, sliced or chunk form, sliced meats, and other food products packaged for retail sale.

DETAILED DESCRIPTION OF THE PREFERRED EMBODIMENT

The invention is generally embodied in a method and apparatus for forming, filling, and sealing a pouch having reclosable, complementary interengagable zipper strips equipped with a slider to facilitate opening and closing of the zipper strips.

Figures 1, 1A, 4:
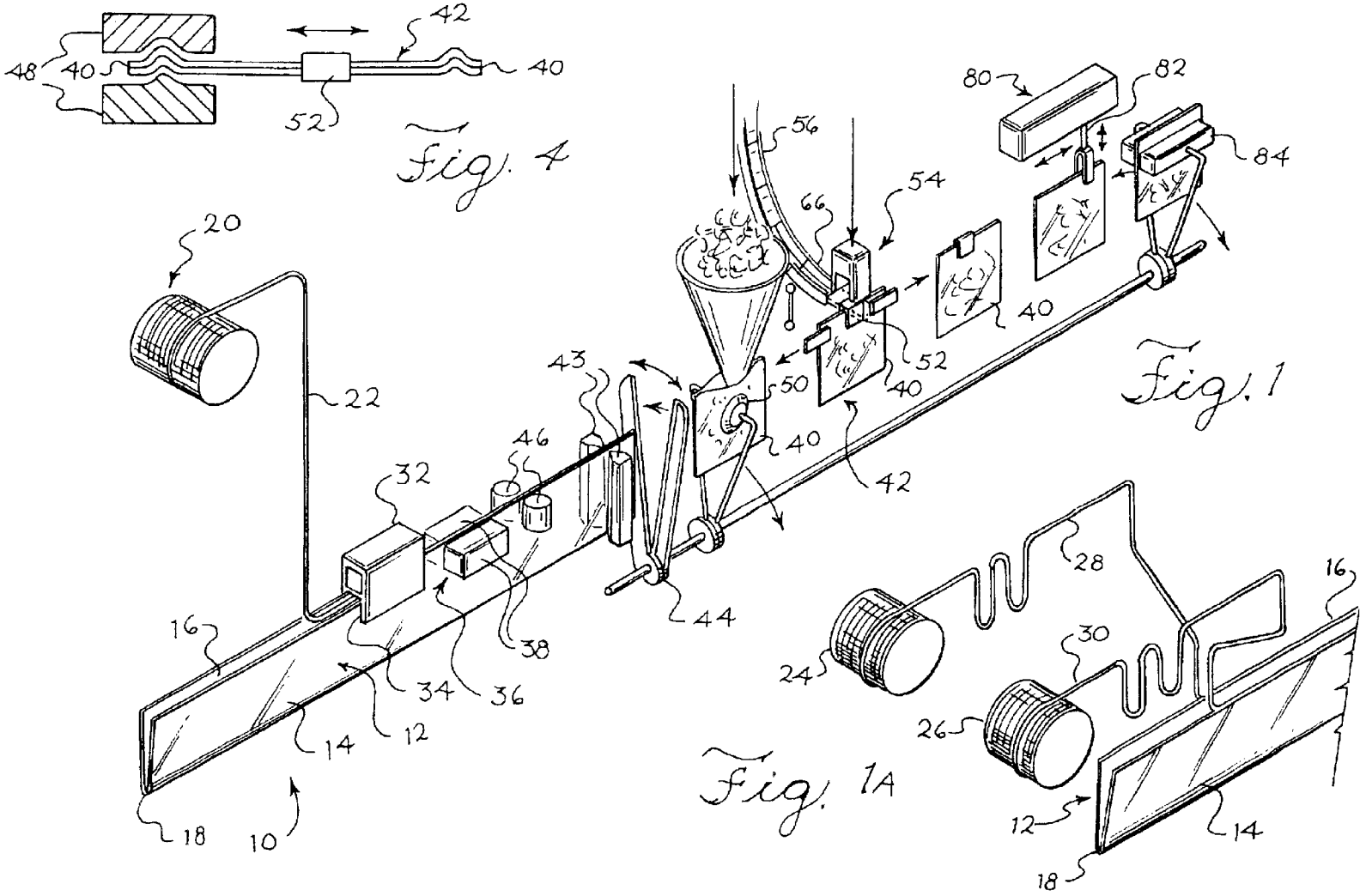
FIG. 1 is a diagrammatic perspective view illustrating apparatus in accordance with a preferred embodiment of the invention.
FIG. 1*a* is a diagrammatic perspective view partially illustrating a second embodiment.
FIG. 4 is a diagrammatic plan view of apparatus for forming stops at the ends of the zipper strips in the apparatus of FIG. 1.

Referring to FIG. 1, the apparatus 10 preferably includes a web 12 of film material for the package walls, comprising first and second wall members 14 and 16. Each of the wall members is oriented in a generally vertical, upstanding position, and the wall members are joined at the bottom by a seal or a fold 18. In the preferred embodiment, the film material is advanced intermittently. In other embodiments, the film material may be advanced continuously.

Zipper strips are inserted between the walls adjacent their upper edges as the wall material is advanced. The zipper strips may comprise a single roll 20 of interlocked strips 22, as shown in FIG. 1, or two separate rolls 24 and 26 having separate zipper strips 28 and 30 thereon, as shown in FIG. 1*a*. The zipper material preferably is of a conventional configuration, with the strips having complementary, interengagable profiles to enable the zipper strips to be interlocked with one another, and flanges or base portions to be welded to the film along the upper edge thereof, with the profiles protruding slightly above the upper edges of the file material.

A zipper chamber 32 receives the zipper strips and aligns them for joinder to the film. A series of tensioning/guiding rollers may be provided to control the zipper strips as they proceed toward the zipper chamber. In the embodiment of FIG. 1, wherein the zipper strips 22 are supplied on a single roll in a joined or interlocked configuration, the zipper chamber 32 separates them prior to aligning them for joinder to the wall material. The zipper chamber is positioned adjacent the upper edges of the wall material and has a central longitudinal slot 34 to receive the zipper strips and the upper portions of the walls.

The zipper strips are joined to the film at a joining station 36. The illustrated joining station comprises a pair of sealing bars 38 positioned on opposite sides of upper portions of the package walls, adjacent the zipper material, and a central dividing plate that keeps the zipper components separate while the flanges of the zipper strips are joined to the film by, e.g., application of heat, or ultrasonic welding. The sealing bars 38 may be transversely reciprocable or may be stationary during operation.

After the zipper strips are joined to the film, side seals 40 are formed to define a pocket or pouch 42 for receiving product. The side seals 40 in the illustrated embodiment are substantially vertical, and are spaced from one another by the desired width of the pocket. The side seals may be formed by a pair of transversely reciprocable heat sealing bars 43, or by other suitable sealing apparatus.

To separate the pouches 42 from the web 12 and from each other, a vertical slit or cut is formed along the center of each side seal. The slit may be formed simultaneously with formation of the side seal, or in a subsequent step as shown by a cutter 44. The cutter can be positioned at any one of several different points, e.g. before filling, immediately after filling, after application of the slider, or at any other desired position.

To provide stops to limit travel of the zipper slider on the zipper in the finished package, the ends of the zipper strips are preferably crushed or molded to form a boss on one side and a recess on the other without adding material. Preferably, heat and pressure are applied to the ends of the zipper strips to accomplish the stop formation.

Formation of the stops is preferably accomplished in two steps. In the first step, a first pair of dies 46 engages the zipper strips at a location corresponding to an end portion of the zipper strips, to apply heat and pressure for a predetermined period of time to crush one end of the zipper and deform the zipper strip ends roughly into the desired configuration. In the second step, upper portions 48 of the heat sealing bars 43 complete the formation of the stops as the side seals are formed.

In other embodiments of the invention, the formation of the stops may comprise a one-step operation, or may involve more than two steps. Furthermore, application of heat and pressure specifically to the zipper end area may be carried out before, during or after formation of the side seals. Also, each step may be performed on two or more zipper ends simultaneously. During formation of the stops, the film is guided by wheels that track the film at the base of the zipper.

Filling of the pouches preferably involves dispensing product downwardly into the pouches through a filling spout to fill the pouches to a predetermined level. In the illustrated embodiment, to provide access to the filling spout, the pouch is opened by use of suction devices, such as vacuum cups 50, applied to the exterior of each wall. In other embodiments, other mechanisms (not shown) may be employed to open the top of the pouch, e.g., by engaging the upper edges of the package walls.

To avoid retention of product by the zipper strips, the filling spout may be vertically movable, so that it may be shifted downward slightly to extend into the pocket during filling.

In the illustrated embodiment, the slider 52 is installed on the zipper at an installation station 54 immediately after filling of the pouch. At the installation station, sliders are fed down a dispensing chute 56, placed in position on the zipper, then clamped onto the zipper. The sliders are preferably supplied to the installation station in bulk form in open position. Batches of sliders are fed to a conventional bowl feeding device that utilizes a combination of chute design, vibratory motion and centrifugal force to orient and discharge the sliders in single file into the dispensing chute. Sensing devices 58 detect presence or absence of the sliders at key zones in the dispensing chute. In the event that the supply of sliders is interrupted, the sensing device may provide a signal to stop the line temporarily. A gate controls the dispensing of the sliders to a metering device. The metering device functions to position the sliders, one at a time, in a centered position relative to the zipper strips.

In the preferred embodiment, an opening device 64 is employed to provide a slot between the zipper strips that is wide enough to allow room for a depending central fin of the slider to fit between the zipper strips. The illustrated opening device employs vacuum cups, applied to the exterior of each wall. In other embodiments, other mechanisms may be employed to open the top of the pouch, e.g., by engaging the upper edges of the package walls.

Figures 2, 3:
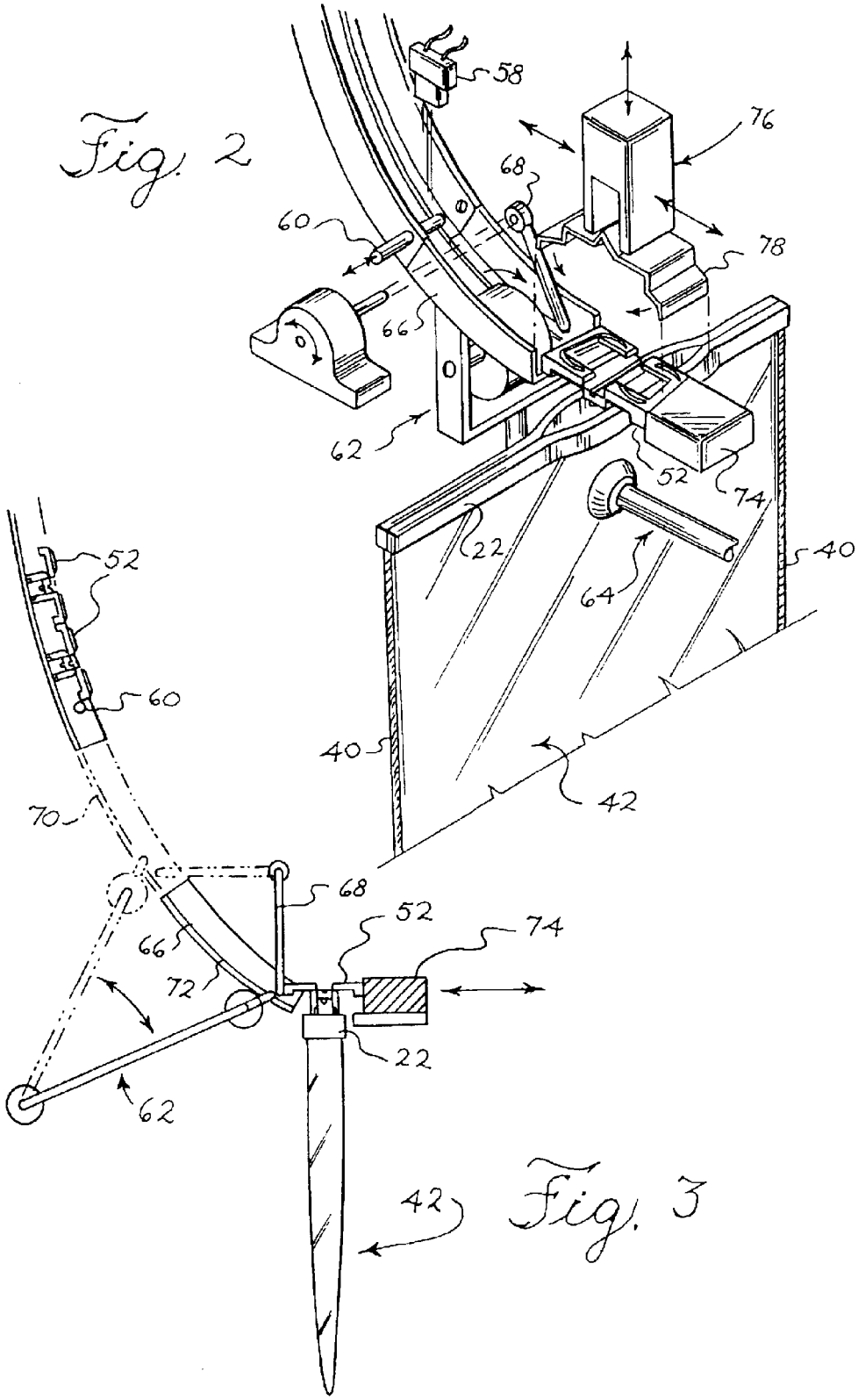
FIG. 2 is a diagrammatic perspective view of apparatus for positioning and closing the slider in the apparatus of FIG. 1.
FIG. 3 is a diagrammatic elevational view of the apparatus of FIG. 2.
Figure 5:
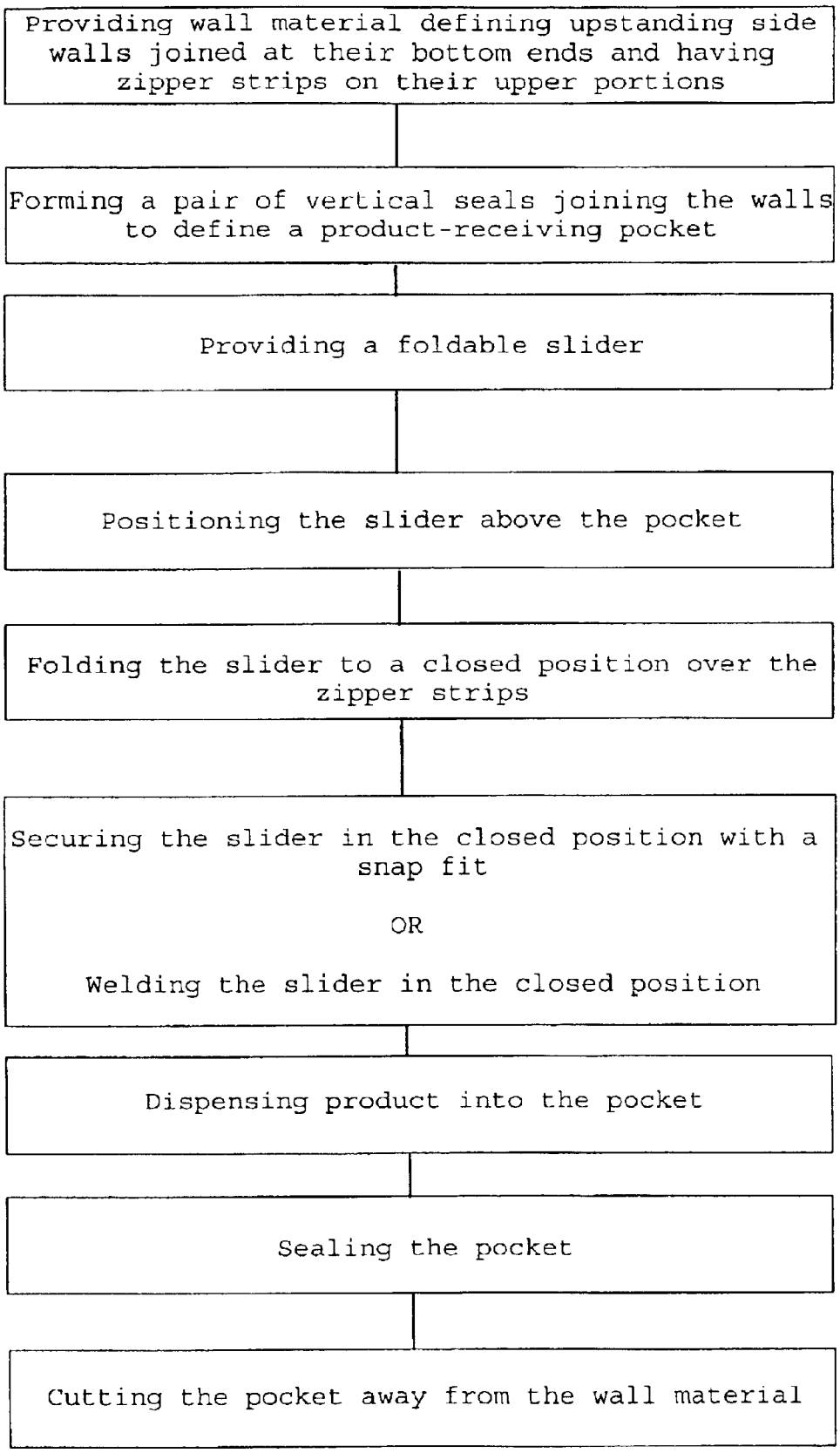
FIG. 5 is a block diagram illustrating operations for forming a pouch.

The metering device 62 comprises a reciprocating mechanism that moves a detachable end portion 66 of the dispensing chute from a first position 70, illustrated in broken lines in FIG. 3, to a second position 72, illustrated in solid lines in FIG. 3, where a sweeper 68 pushes the slider from the end portion of the chute against a stop 74, at which point the slider is in position to be clamped onto the zipper. The slider is then closed by a gripper/end effector assembly 76 which is lowered into engagement with the slider. The end effector 78 in the illustrated embodiment is configured to force the slider into its closed position. Mechanical locking means such as a snap fit arrangement may be provided on the slider to lock it in closed position. In other embodiments, the end effector may include apparatus for welding or sealing the slider in its closed position, using, e.g., heat or ultrasonic welding techniques.

While the slider is being clamped in place, the metering device 62 shifts back to its first position, and the gate 60 is opened to permit the next slider to move onto the removable end portion 66 of the chute, and the process repeats itself.

The sweeper 68 in the illustrated embodiment comprises a single elongated member that is rotatable about one of its ends, and is driven intermittently by a rotary actuator in timed relation with reciprocation of the metering device.

In order to maximize throughput rates, multiple slider application stations may be provided in the line.

After installation of the slider, the pouch proceeds to a zipper-closing station 80, where the slider is engaged by a closing device 82, and moved longitudinally relative to the pouch to close the zipper. The closing may be accomplished by a rodless air cylinder with a pneumatic actuator that lowers around the slider and shifts the slider toward its closed position.

A peelable seal is then provided beneath the zipper. In the preferred embodiment, a hermetic peelable seal is applied. The peelable seal may be formed between flange or base portions of the zipper strips by heating sealing bars 84 or other suitable apparatus.

From the foregoing, it should be apparent that the invention provides a novel and improved method and apparatus for application of reclosable zippers to food packaging in form/fill/seal operations, wherein a slider is incorporated into the reclosable zipper arrangement in an economical and commercially practical method and apparatus. The invention is not limited to the embodiment described above, nor to any other particular embodiment. For example, while the slider is installed on the zipper strips after filling and before formation of the peelable seal in the illustrated embodiment, the slider might be applied before filling or after formation of the peelable seal in other embodiments. Also, while the illustrated embodiment shows heat seal bars to perform joining or sealing steps, it is contemplated that these steps might alternatively involve other or additional apparatus to effect joinder or sealing using, e.g., ultrasonic welding, RF sealing, or use of adhesives. Also, the sealing bars may be stationary or transversely reciprocable, or may be disposed on wheels or belts so as to have a longitudinal motion component, so that joinder or sealing may be carried out with either intermittent or continuous travel of the film.

The invention is further described and pointed out in the following claims.

We claim:

1. An apparatus for forming, filling and sealing a pouch for food products, comprising:

means for providing wall material defining a pair of upstanding side walls joined to one another at their bottom ends and having complementary interengageable fastener strips extending between said side wails on upper portions thereof;

means for moving said wall material along a plurality of stations for performing sequential operations on the wall material;

a first station with means for forming a pair of spaced-apart substantially vertical seals, separated by a preselected distance, joining said side walls so as to define a product-receiving pocket having a width determined by the pre-selected distance between said vertical seals;

a second station with means for dispensing product between said fastener strips, downwardly into said product-receiving pocket;

a third station with means for providing a slider and for engaging the slider with the fastener strips after product is dispensed to fill said pocket;

a fourth station with means for shifting the position of the slider to close the fastener strips;

a fifth station with means for forming a hermetic peelable seal beneath said fastener strips and between said side walls, said means for forming a hermetic peelable seal located downstream of said means for dispensing and said means for engaging the slider with the fastener strips so that the hermetic peelable seal is formed after the pocket is filled and the slider is mounted to the fastener strips and after the position of the slider is shifted to close the fastener strips;

a sixth station with means for crushing the ends of said fastener strips to maintain said slider captive on said fastener strips; and a seventh station with means for cutting the pocket away from the wall material to form an individual pouch.

* * * * *

UNITED STATES PATENT AND TRADEMARK OFFICE

CERTIFICATE OF CORRECTION

PATENT NO. : 6,834,474 B2
DATED : December 28, 2004
INVENTOR(S) : Dutra et al.

It is certified that error appears in the above-identified patent and that said Letters Patent is hereby corrected as shown below:

Title page,
Item [56], References Cited, OTHER PUBLICATIONS, "Hefty's Plastic Zipper Bag is Rapping Rivals" reference, delete "wit", and insert -- with --.

Column 6,
Line 2, delete "wails" and insert -- walls --.

Signed and Sealed this

Twenty-eighth Day of June, 2005

JON W. DUDAS
*Director of the United States Patent and Trademark Office*